US009764892B2

(12) United States Patent
DePietro

(10) Patent No.: US 9,764,892 B2
(45) Date of Patent: Sep. 19, 2017

(54) COVER ALIGNMENT TOOL

(71) Applicant: Edward A. DePietro, Manchester, NH (US)

(72) Inventor: Edward A. DePietro, Manchester, NH (US)

(73) Assignee: Universal Hinge Corporation, Manchester, NH (US)

( * ) Notice: Subject to any disclaimer, the term of this patent is extended or adjusted under 35 U.S.C. 154(b) by 463 days.

(21) Appl. No.: 14/137,094

(22) Filed: Dec. 20, 2013

(65) Prior Publication Data

US 2014/0182112 A1 Jul. 3, 2014

Related U.S. Application Data

(60) Provisional application No. 61/740,070, filed on Dec. 20, 2012.

(51) Int. Cl.

| | |
|---|---|
| ***E02D 29/14*** | (2006.01) |
| ***B65D 90/10*** | (2006.01) |
| ***B25B 27/16*** | (2006.01) |

(52) U.S. Cl.

CPC ..... *B65D 90/10* (2013.01); *B25B 27/16* (2013.01); *Y10T 29/49895* (2015.01); *Y10T 29/53913* (2015.01)

(58) Field of Classification Search

CPC ... B65D 90/10; B25B 27/16; Y10T 29/53913; Y10T 29/49895; Y10T 29/53678; Y10T 29/53567; Y10T 29/4984; Y10T 29/49819; B66C 23/208

See application file for complete search history.

(56) References Cited

U.S. PATENT DOCUMENTS

| | | | | |
|---|---|---|---|---|
| 2,393,795 | A * | 1/1946 | Miller | B25B 27/16 254/100 |
| 8,038,031 | B2 * | 10/2011 | DePietro | B65D 90/10 16/382 |
| 2005/0242051 | A1 | 11/2005 | Porebski et al. | |
| 2008/0078127 | A1 | 4/2008 | Hill et al. | |
| 2010/0230553 | A1 | 9/2010 | Wolfford, Sr. | |
| 2012/0285975 | A1 | 11/2012 | DePietro et al. | |

OTHER PUBLICATIONS

PCT International Search Report, PCT/US2014/031389, Korean Intellectual Property Office, Mailed Jul. 30, 2014.

* cited by examiner

*Primary Examiner* — Jacob Cigna
*Assistant Examiner* — Lee A Holly
(74) *Attorney, Agent, or Firm* — Robert R. Deleault, Esq.; Mesmer & Deleault, PLLC

(57) ABSTRACT

An alignment tool device for use in aligning a manway cover to a manway body/flange during installation of the manway cover includes a first plate with an L-shape has body with a pair of holes and a first tongue extending transversely from the plate. A second plate with an inverted-L shape has a body with a pair of holes and a second tongue extending transversely from the plate. The first plate is oriented substantially parallel to and opposing the second plate with the first tongue extending parallel to and overlapping the second tongue, where the first and second tongues extend in opposite directions. A height adjuster displaces the first plate relative to the second plate by adjustable engagement of the tongues.

14 Claims, 9 Drawing Sheets

COVER ALIGNMENT TOOL

BACKGROUND OF THE INVENTION

1. Field of the Invention

The present invention relates generally to "manway" covers for access to enclosed spaces such as tanks, conduits, storage areas, heat exchanger tubes, and the like. Particularly, the present invention relates to mechanisms to assist in the removal of "manway" covers. More particularly, the present invention relates to mechanisms for handling the removal and installation of "manway" covers that are too heavy to be handled by an unaided individual.

2. Description of the Prior Art

Manway covers are typically large, heavy, metal plates that are bolted to an opening. For purposes of the present invention, the definition of "manway covers" expressly means any heavy covers or closures having a weight of thirty-five (35) pounds or more used on pressure vessels, vacuum vessels, atmospheric vessels, heat exchangers, heat exchanger channel covers, heat exchanger channels, heat exchanger bonnets, or any type of blanking plate and is not construed to be limited to only covers used on openings that are dimensionally-sized to allow passage of a man. The most common are circularly-shaped and mate to a flange by way of a plurality of bolts evenly spaced around the periphery of the opening. However, it should be understood that the heavy covers may be any shape. The defined manway covers typically provide access to enclosed spaces such as tanks, conduits, storage areas, transfer tubes, pressure vessels, vacuum vessels, atmospheric vessels, heat exchangers, heat exchanger channel covers, heat exchanger channels, heat exchanger bonnets, and the like.

Routine servicing and inspection requirements as well as other operating conditions necessitate periodic removal of these manway covers. In view of the typical location and weight of the manway covers, it is not a simple task to remove the cover or to re-install the same. Removal is currently accomplished with the use of hand operated davit swing arms, chain falls, ratchet hoists, portable hinge devices, and brute force. Except for davit swing arms and portable hinge devices, it is necessary during the removal process to lower the covers a distance to a level surface.

SUMMARY OF THE INVENTION

It is an object of the present invention to provide a simple, removable, reusable manway cover alignment tool to facilitate installation of a manway cover to a manway flange.

The present invention achieves these and other objectives by providing an alignment tool device for use in aligning a manway cover to a manway body/flange during installation of the manway cover to the manway flange. The alignment tool includes a pair of plates with openings in each plate where the openings are spaced for alignment with manway cover bolt openings and/or manway flange bolt openings. Each plate has a tongue fixedly attached to each respective plate and extending transversely from the plate where the tongues of a pair of plates are positioned to be parallel, and extend opposed to each other and overlap when one of the pair of plates is removably mounted on a manway cover and the other of the pair of plates is removably mounted on a corresponding manway flange. The extending tongue of the plate mounted to the manway cover includes a height adjuster mechanism that contacts the tongue on the flange plate. The height adjuster mechanism is adjustable along an adjuster longitudinal axis of the height adjuster where the adjuster longitudinal axis is transverse to the longitudinal axis of the tongues and orthogonal to opening in the pair of plates.

In one embodiment of the present invention, an alignment tool device includes a removable cover alignment plate, a removable flange alignment plate, and a height adjuster. The removable cover alignment plate defines a longitudinal plane where the cover alignment plate has an elongated cover plate body, an upper plate portion connected to the cover plate body and extending along the longitudinal plane, and a cover plate tongue that extends from the upper plate portion in a transverse orientation from the longitudinal plane. The cover plate body has an inside cover body edge, an outside cover body edge, and a pair of spaced-apart body openings located a predefined distance from the outside cover body edge.

The removable flange alignment plate defines a longitudinal plane where the flange alignment plate has an elongated flange plate body, a lower plate portion connected to the flange plate body and extending along the longitudinal plane, and a flange plate tongue that extends from the lower plate portion in a transverse orientation from the longitudinal plane. The flange plate body has an inside flange body edge, an outside flange body edge and a pair of spaced-apart body openings located a predefined distance from the outside flange body edge.

The height adjuster extends transversely through the cover plate tongue along a height adjuster longitudinal axis that is parallel to the longitudinal plane. The height adjuster is capable of longitudinal displacement along the height adjuster longitudinal axis relative to the cover plate tongue whereby the cover plate tongue is parallel to, above, and opposed to the flange plate tongue. When the cover alignment plate is attached to a manway cover and when the flange alignment plate is attached to a manway flange, the cover plate tongue extends towards a space defined by the lower plate portion of the flange plate and the inside flange plate edge. Similarly, the flange plate tongue extends towards a space defined by the upper plate portion of the cover plate and the inside cover plate edge. The height adjuster contacts the flange plate tongue to provide spatial, vertical displacement of the cover plate tongue relative to the flange plate tongue for adjustably aligning a plurality of manway cover bolt openings with a plurality of corresponding manway flange bolt openings.

In another embodiment of the present invention, the removable cover alignment plate includes a bracing gusset directly connected to the cover tongue and the upper plate portion of the cover plate body.

In still another embodiment of the present invention, the removable flange alignment plate includes a bracing gusset directly connected to the flange tongue and the lower plate portion of the flange plate body.

DETAILED DESCRIPTION OF THE PREFERRED EMBODIMENT

Figure 1:
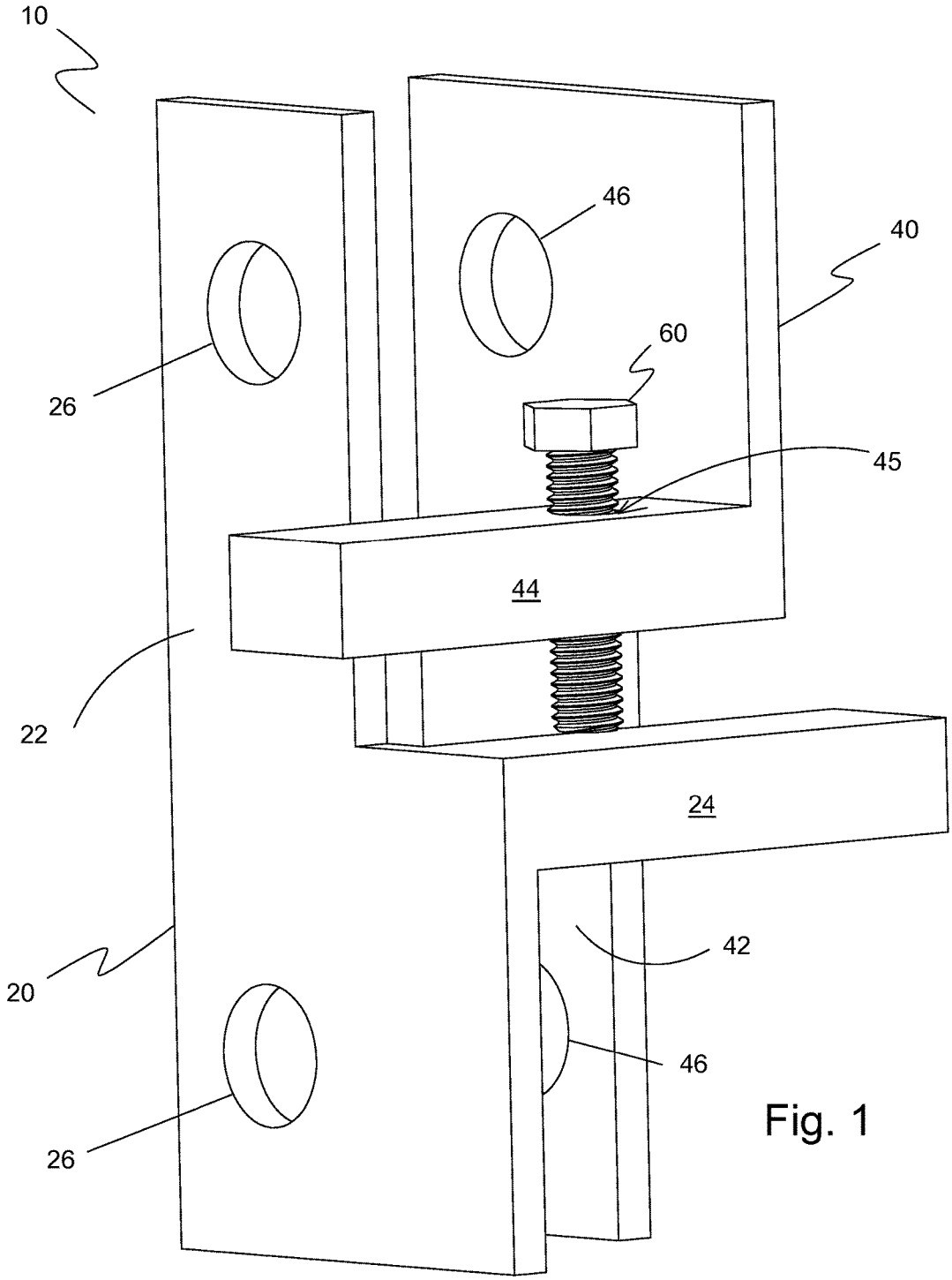
FIG. 1 is a perspective view of one embodiment of the present invention showing the cover plate, the flange plate and the height adjuster.

The preferred embodiments of the present invention are illustrated in FIGS. 1-12. FIG. 1 shows one embodiment of a cover alignment tool 10 of the present invention. Cover alignment tool 10 has a flange plate 20, a cover plate 40 and a height adjuster 60. Flange plate 20 has a flange plate body 22 and a plurality of openings 26 for receiving a pin (shown in FIG. 12) that secures flange plate 20 to a manway flange. Cover plate 40 has a cover plate body 42 and a plurality of body openings 46 also for receiving a pin (shown in FIG. 12) that secures the cover plate 40 to a manway cover that attaches to the manway flange. Flange plate 20 has a flange plate tongue 24 that is fixedly attached to flange plate 20 and that extends in a transverse orientation from flange plate body 22. Cover plate 40 has a cover plate tongue 46 that is fixedly attached to cover plate 40 and that extends in a transverse orientation from cover plate body 42. Cover plate tongue 44 has a tongue opening 45 for receiving height adjuster 60, which height adjuster 60 is oriented orthogonal to the openings 26, 46. Preferably, tongue opening 45 is threaded and threadably receives height adjuster 60.

Figure 2:
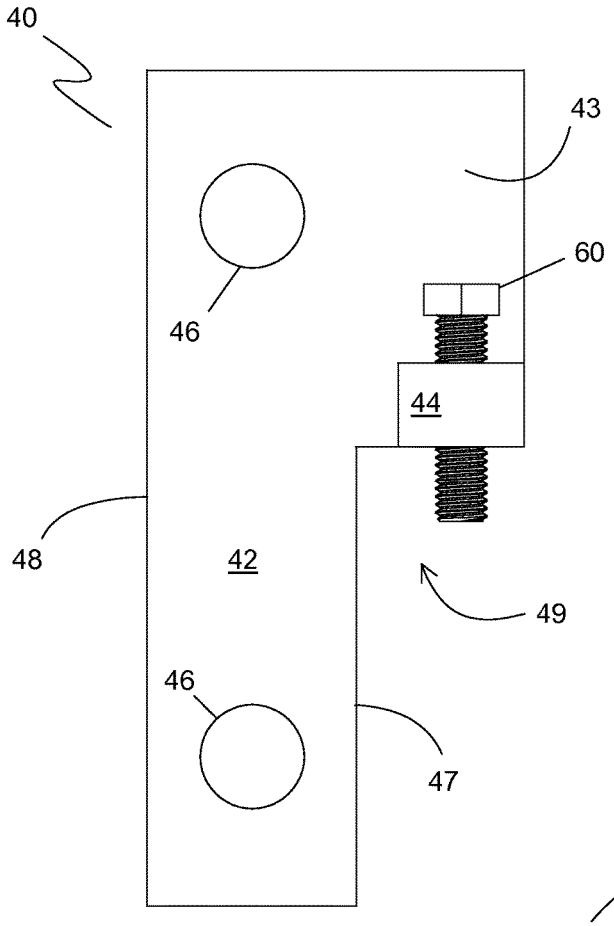
FIG. 2 is a front view of one embodiment of the cover plate shown in FIG. 1

FIG. 2 illustrates a front view of cover plate 40. As shown, cover plate body 42 has an inside cover body edge 48, an outside cover body edge 47, a plurality of spaced-apart body openings 46 located a predefined distance from outside cover body edge 47, and an upper plate portion 43. Upper plate portion 43 is co-planar with cover plate body 42 and extends from outside cover body edge 47. In one embodiment, upper plate portion 43 and cover plate body 42 together define an inverted-L shape when cover plate 40 is oriented as shown in FIG. 2. Cover plate tongue 44 extends from upper plate portion 43 in a transverse orientation toward the viewer out of the plane of FIG. 2. Height adjuster 60 threadably engages and is threadably adjustable in position relative to cover plate tongue 44. Upper plate portion 43 and outside cover plate edge 47 define a space 49 below upper plate portion 43.

Figure 3:
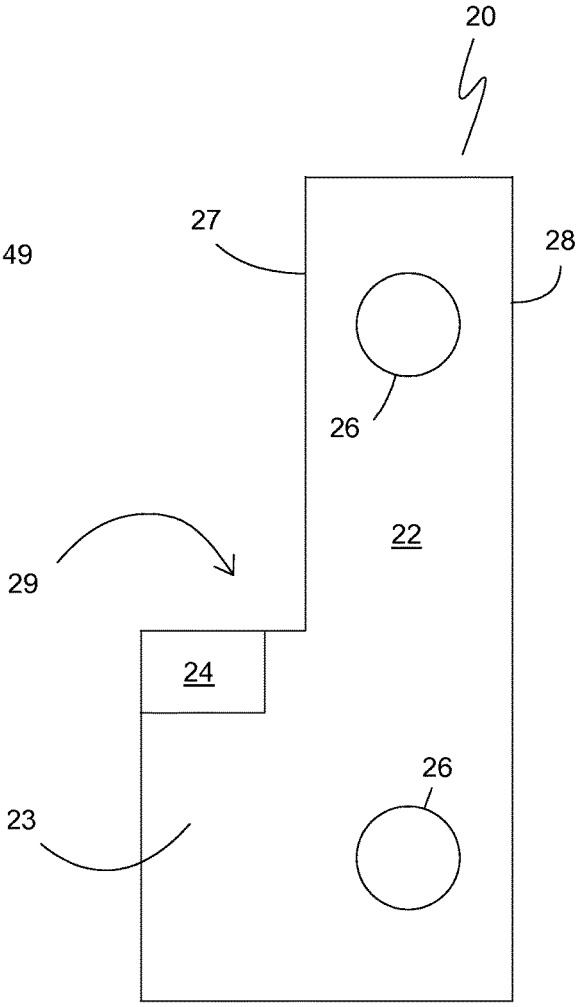
FIG. 3 is a front view of one embodiment of the flange plate shown in FIG. 1

FIG. 3 illustrates a front view of flange plate 20. As shown, flange plate body 22 has an inside flange body edge 28, and outside flange body edge 27, a plurality of spaced-apart body openings 26 located a predefined distance from outside flange body edge 27, and a lower plate portion 23. Lower plate portion 23 is co-planar with flange body 22 and extends from outside flange body edge 27. In one embodiment, lower plate portion 23 and flange body 22 together define an L-shape. Flange plate tongue 24 extends from lower plate portion 23 in a transverse orientation toward the viewer out of the plane of FIG. 3. Lower plate portion 23 and outside flange plate edge 27 define a space 29 above lower plate portion 23.

In one embodiment, flange plate 20 is substantially identical to cover plate 40 with exception of threaded opening 45 that extends through cover plate tongue 44 and the orientation of each when flange plate 20 is assembled with cover plate 40.

Figure 4:
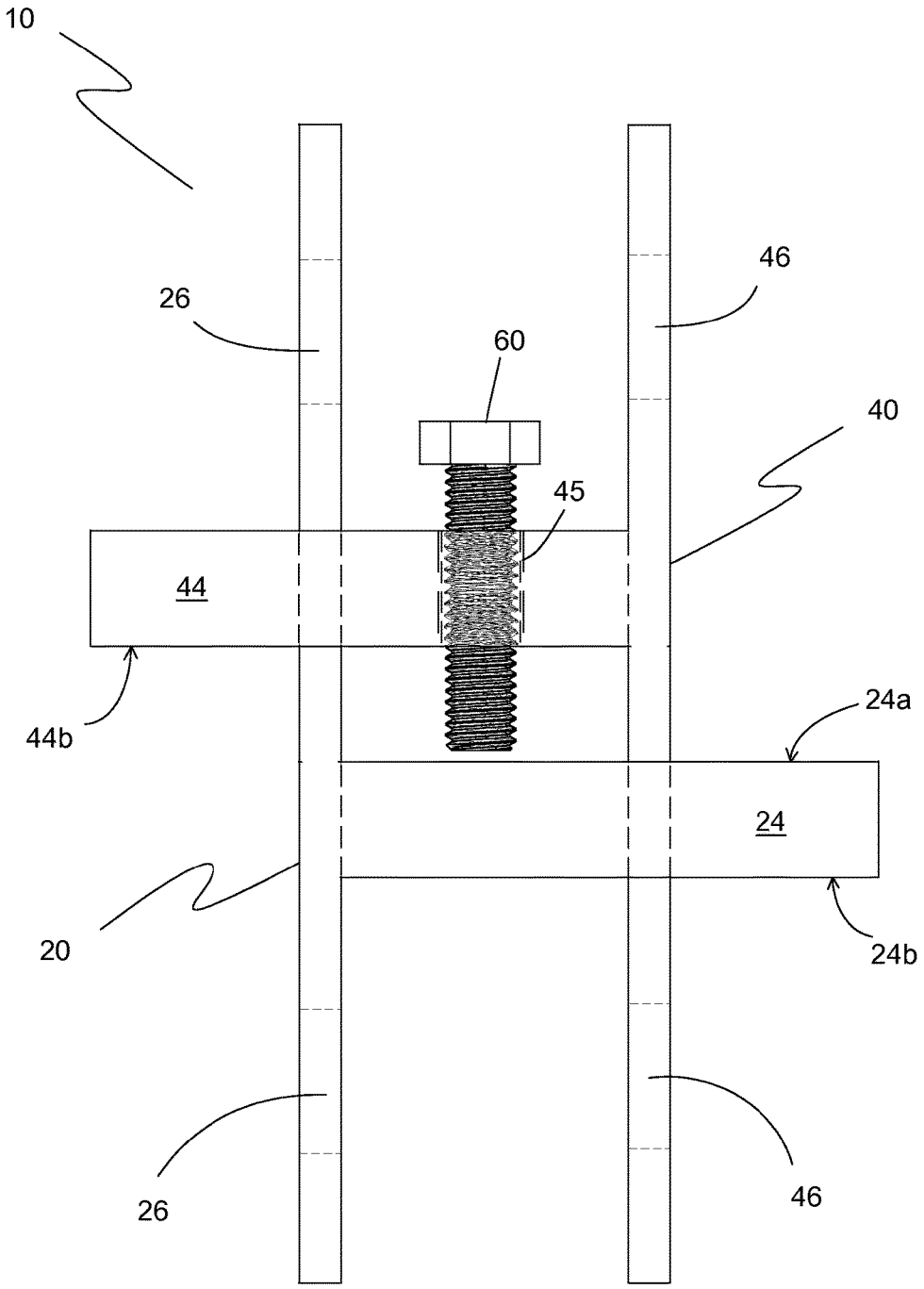
FIG. 4 is an outside view of the embodiment shown in FIG. 1.

FIG. 4 illustrates an outside view of flange plate 20, cover plate 40 and height adjuster 60. In use, height adjuster 60 would contact the top surface 24*a* of flange plate tongue 24 in order to vertically adjust a cover attached to cover plate 40 in order to align the cover openings in the manway cover with their respective flange openings in the manway flange. Although flange plate tongue 24 and cover plate tongue 44 are shown to extend beyond the opposed cover plate 40 and flange plate 20, respectively, the tongues 24, 44 may extend any predefined length so long as the tongues 24, 44 overlap sufficient for height adjuster 60 to engage both tongues and the overlap is sufficient to accomplish the purpose of aligning the cover openings of a manway cover with the respective flange openings of a manway flange. For example, cover plate tongue 44 may be a fixed size since it incorporates height adjuster 60, which is typically threadably fixed into and extends through a single, threaded opening 45 in cover plate tongue 44. Cover plate tongue 44, however, may have more than one threaded opening 45 in a longer extending tongue that provides the user with optional locations for threadably attaching height adjuster 60 to cover plate tongue 44. Flange plate tongue 24, in this embodiment, would extend with sufficient length to provide height adjuster 60 a contact surface (e.g., top surface 24*a*) on which height adjuster 60 makes contact for adjustably moving cover plate 40 vertically relative to flange plate 20. It should be understood by the skilled artisan that flange plate tongue 24 of flange plate 20 may alternatively incorporate a threaded opening (not shown) for threadably receiving height adjuster 60. In this alternative embodiment, height adjuster 60 would enter flange plate tongue 24 from the bottom surface 24*b* of flange plate tongue 24 and would contact the bottom surface 44*b* of cover plate tongue 44 in order to provide a similar adjustment to the vertical position of the cover to align the cover openings with their respective flange openings.

In one embodiment, height adjuster 60 is a double-ended threaded stud configured to threadably engage both of cover plate tongue 44 and flange plate tongue 24. One end of height adjuster 60 threadably engages a threaded opening 45 in cover plate tongue 44; the other end of height adjuster 60 threadably engages a threaded opening 45*a* in flange plate tongue 24. Similar to a turnbuckle, when the double-ended threaded stud is rotated in one direction, it causes the cover plate tongue 44 and the flange plate tongue 24 to move towards each other. When the double-ended threaded stud is rotated in the opposite direction, it causes tongues 24, 44 to move away from each other.

Figure 5:
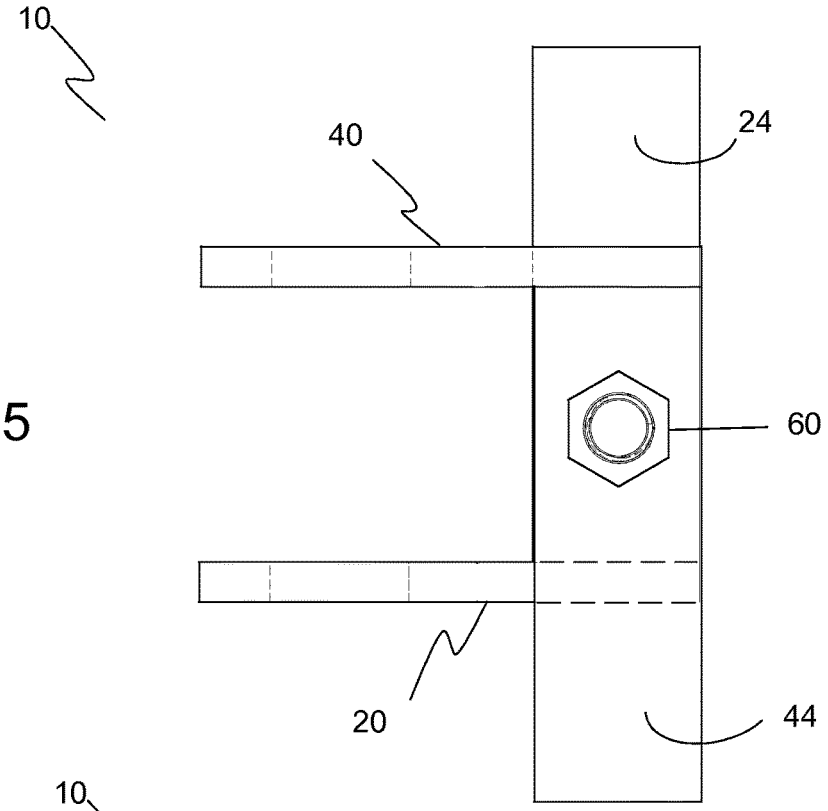
FIG. 5 is a top view of the embodiment shown in FIG. 1.
Figure 6:
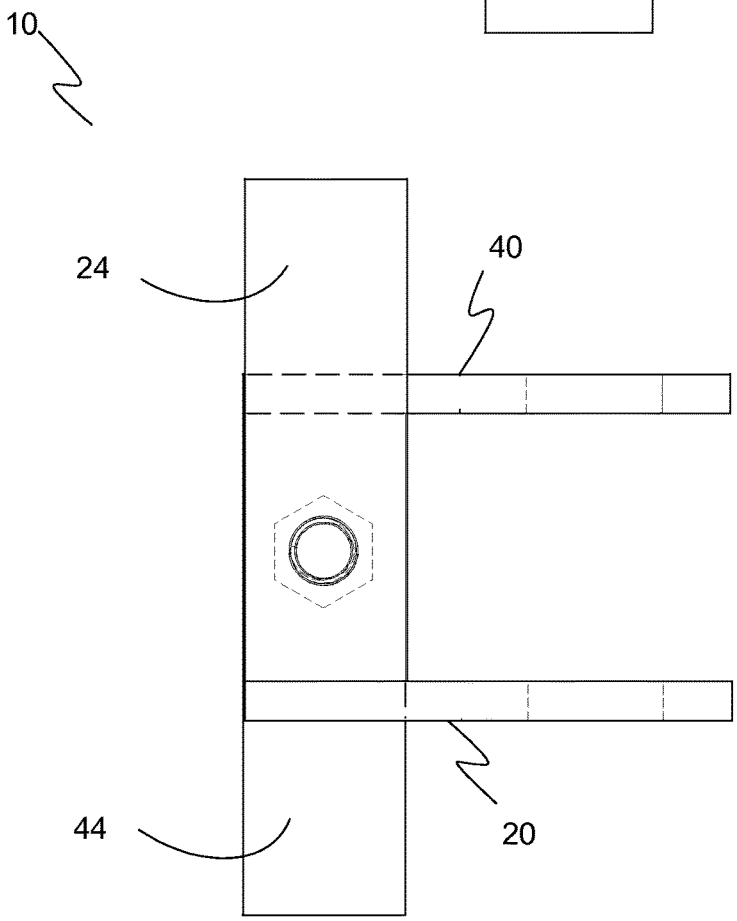
FIG. 6 is a bottom view of the embodiment shown in FIG. 1.
Figure 7:
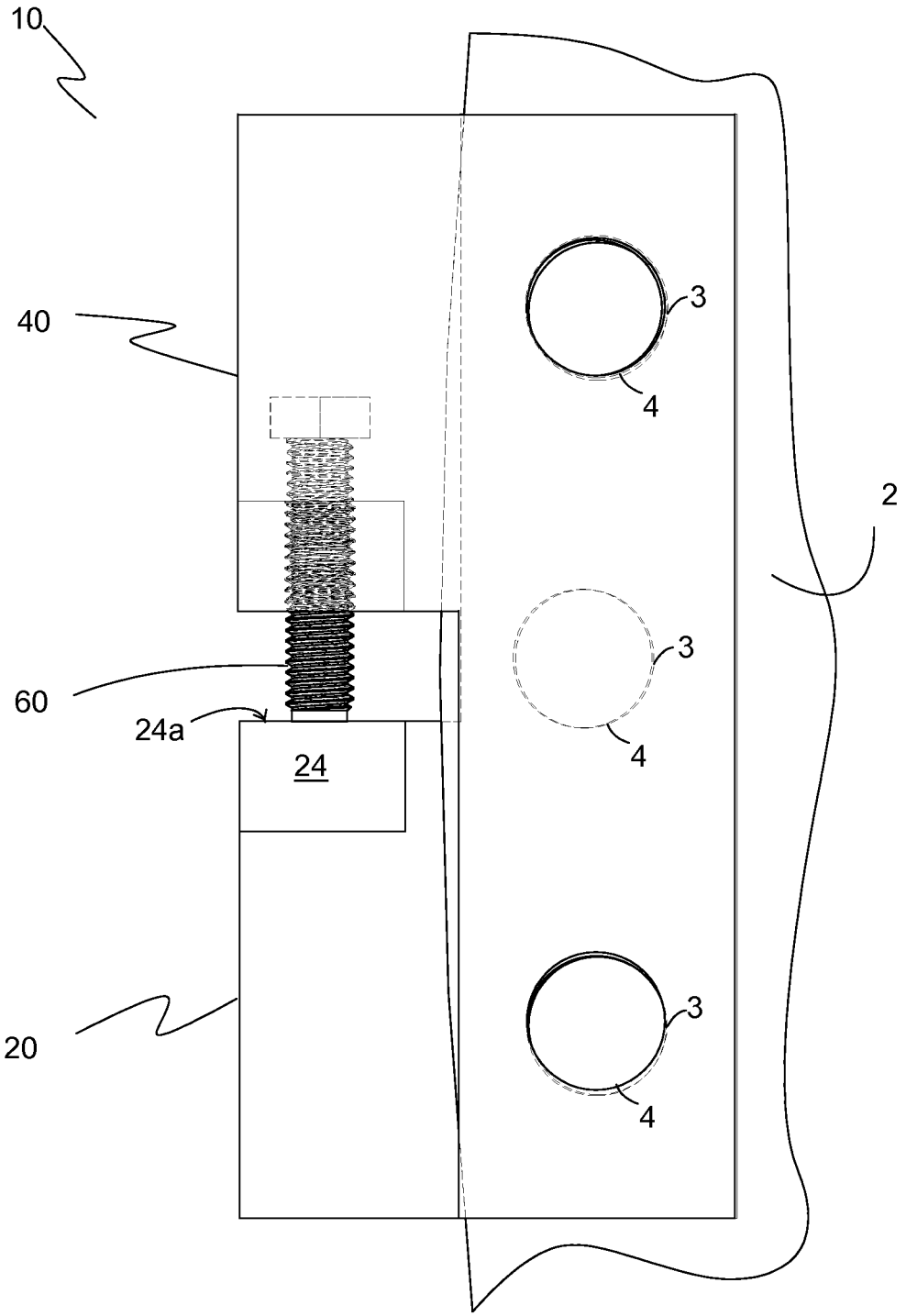
FIG. 7 is a cover-side view showing the cover and flange relative to the cover alignment tool.
Figure 8:
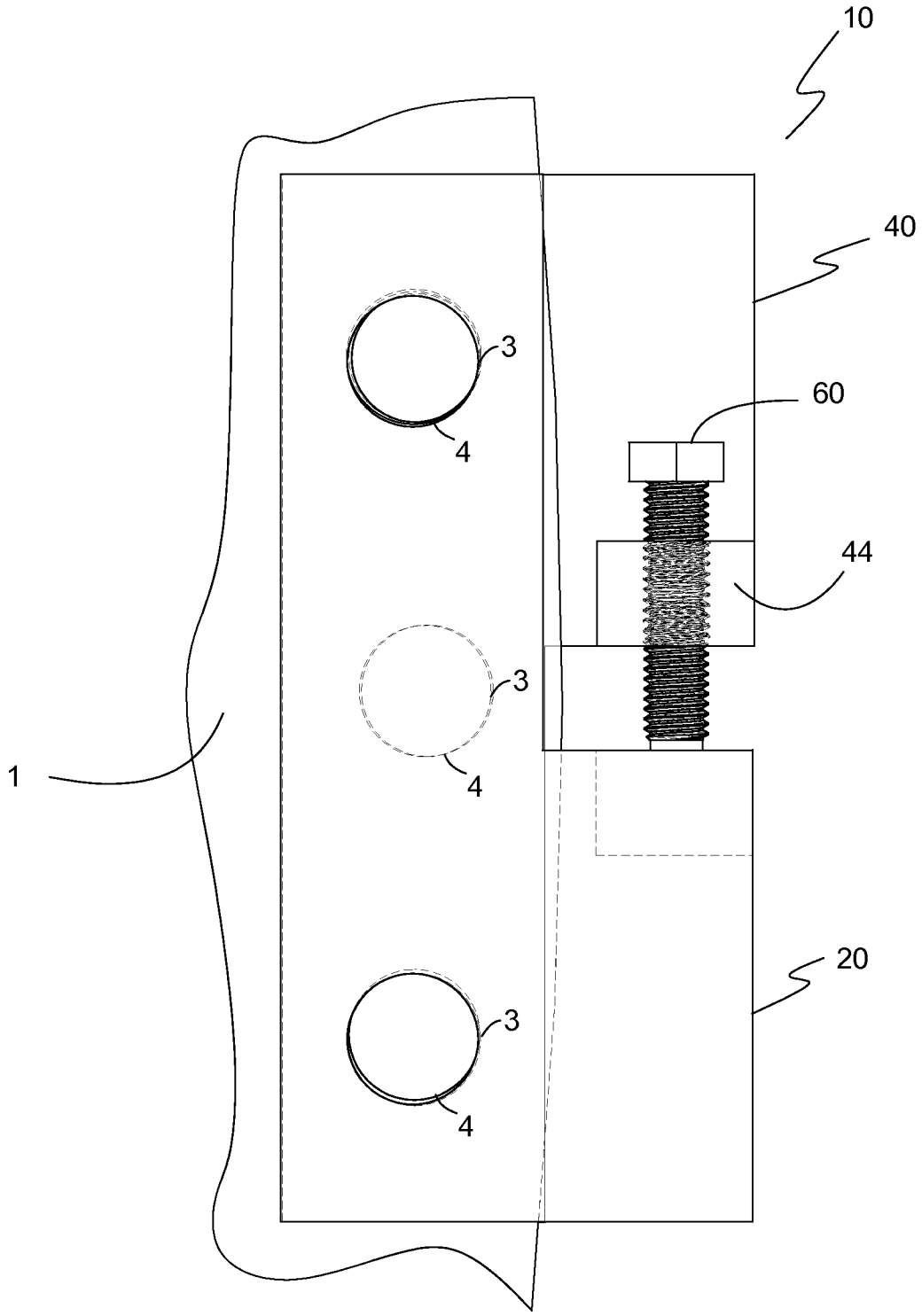
FIG. 8 is a cover-side view showing the cover and flange relative to the cover alignment tool.

FIG. 5 illustrates a top view of cover alignment tool 10 while FIG. 6 illustrates a bottom view of cover alignment tool 10. FIG. 7 illustrates a cover-side view of cover alignment tool 10 with the openings 3 of a cover 2 aligned with the openings 4 in a flange 1 (shown in FIG. 8). As shown in the embodiment of FIG. 7, height adjuster 60 contacts the top surface 24*a* of flange plate tongue 24 (or is capable of contacting top surface 24*a* by advancing height adjuster 60 through threaded opening 45). FIG. 8 illustrates a flange side view of cover alignment tool 10 shown in FIG. 7 with the openings 4 of flange 1 aligned with the openings 3 of cover 2 (not shown). Openings 3, 4 also align with openings 26, 46 of flange plate 20 and cover plate 40, respectively.

Figure 9:
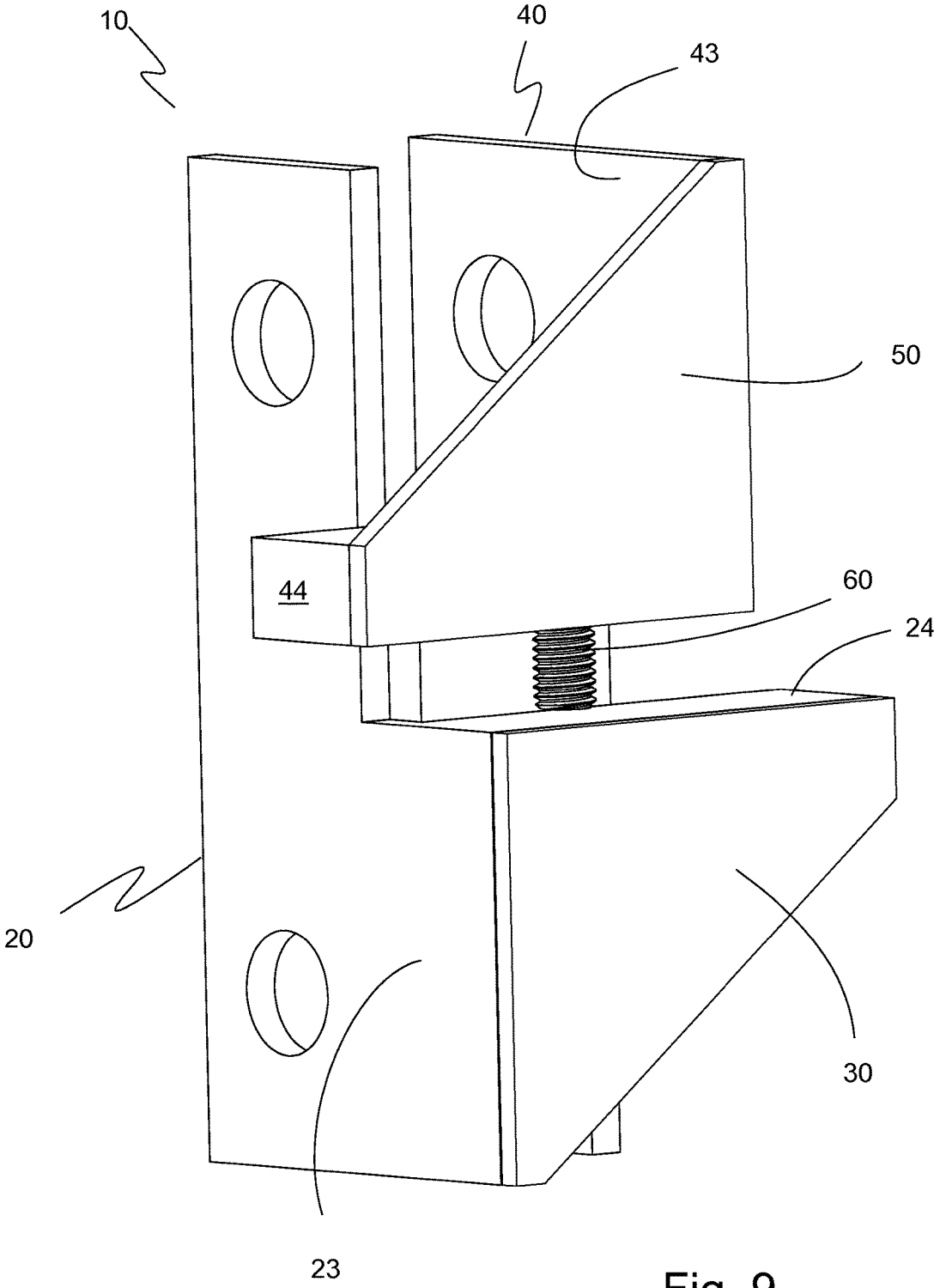
FIG. 9 is a perspective view of another embodiment of the present invention showing the cover plate and flange plate with gussets.

FIG. 9 illustrates a perspective view of another embodiment of the present invention. For consistency, the same structural features in this embodiment use the same reference numbers for similar structural features in the embodiment shown in FIG. 1. In this embodiment, cover alignment tool 10 has flange plate 20, cover plate 40, height adjuster 60, an optional flange gusset 30, and an optional cover gusset 50. Optional flange gusset 30 provides additional reinforcement between lower flange portion 23 and flange tongue 24. Like flange gusset 30, optional cover gusset 50 provides additional reinforcement between upper cover portion 43 and cover tongue 44. Gussets 30, 50 preferably are a generally planar sheet having the general shape of a right triangle that extends along the respective flange plate tongue 24 or cover plate tongue 44 and along the respective lower plate portion 23 or upper plate portion 43. Gussets 30, 50 are preferably made of metal.

Gusset 30 is typically and preferably welded to flange plate tongue 24 and to lower plate portion 23. Similarly, gusset 50 is typically and preferably welded to cover plate tongue 44 and to upper plate portion 43. Other attachment means are acceptable, including the use of fasteners, brackets, and the like. Because the weight of manway covers vary with some covers weighing many times more than others, gussets 30, 50 each adds additional strength and rigidity to the respective tongues 24, 44 since tongues 24, 44 endure the full weight of cover 2 when a cover height adjustment is performed. Gussets 30, 50 help prevent and/or minimize potential bending of tongues 24, 44 during the cover height adjustment process.

Figure 10:
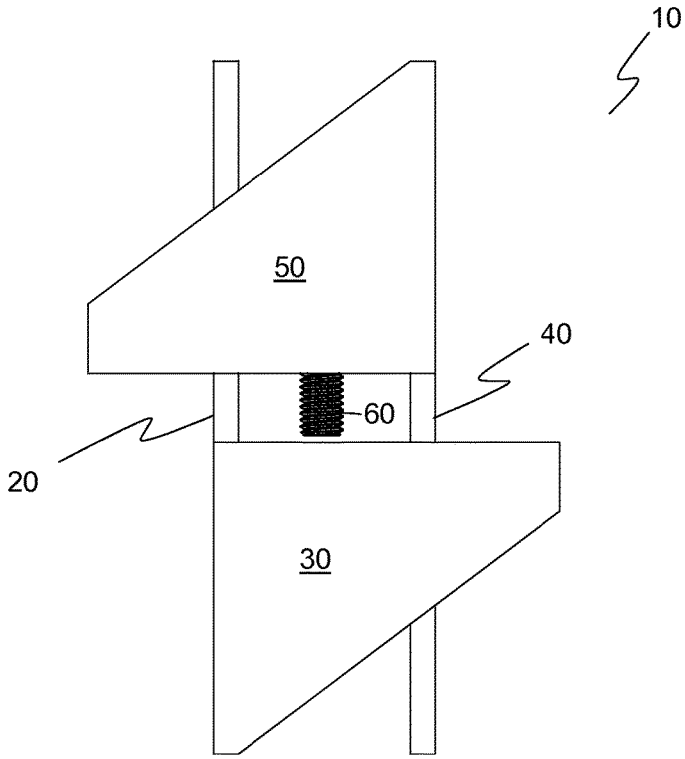
FIG. 10 is an outside view of the embodiment shown in FIG. 9.
Figure 11:
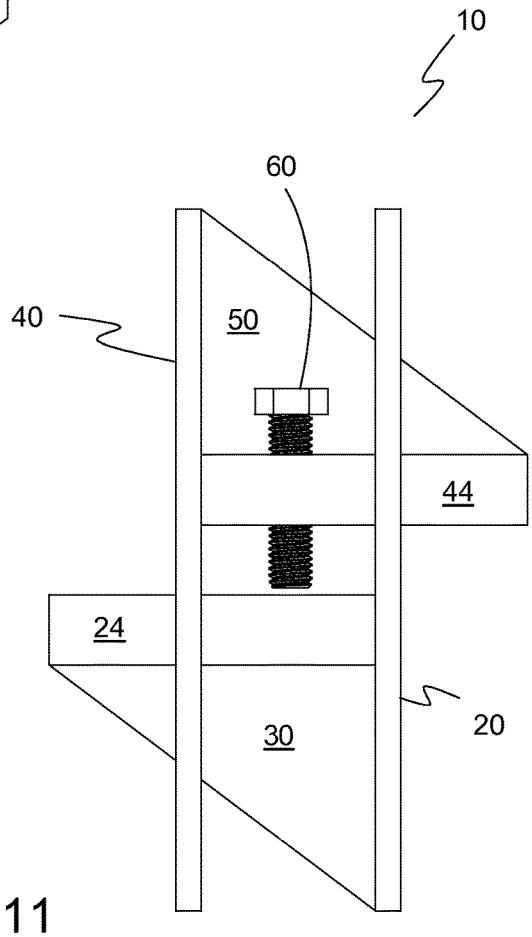
FIG. 11 is an inside view of the embodiment shown in FIG. 9.

FIGS. 10 and 11 illustrate outside and inside views, respectively, of the gusseted cover alignment tool 10. It is noted that gussets 30, 50 may be any size desired even though they are illustrated as a triangularly-shaped structure extending over the entire length of their respective tongues 24, 44 and between the top and bottom perimeter edges of the respective lower and upper portions 23, 43.

Figure 12:
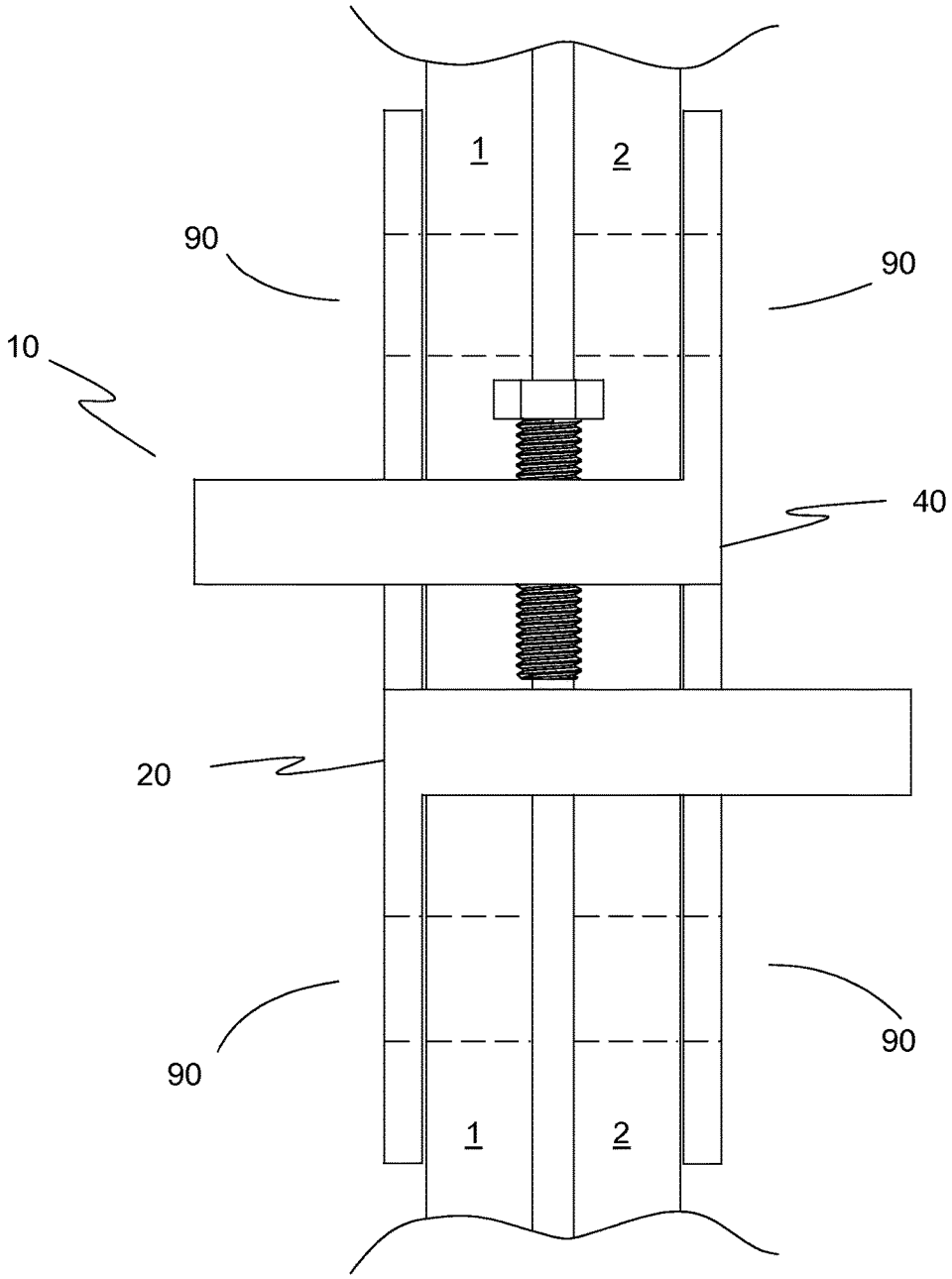
FIG. 12 is an outside view of the embodiment shown in FIG. 1 including a partial view of the cover, flange and pins.

FIG. 12 illustrates an outside view of cover alignment tool 10 with a partial view of flange 1 and cover 2 with pins 90 securing flange plate 20 to flange 1 and securing cover plate 40 to cover 2.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An alignment tool for aligning a manway cover to a corresponding manway flange, the alignment tool comprising:

a cover plate comprising:

a cover plate body having a plurality of body openings, the plurality of body openings oriented to align with corresponding manway cover openings; and a cover plate tongue fixedly attached to the cover plate body and extending perpendicularly from an outside cover body edge of the cover plate body and transverse to the cover plate body;

a flange plate comprising a flange plate body having a plurality of flange plate openings, the plurality of flange plate openings oriented to align with corresponding manway flange openings; and a flange plate tongue fixedly attached to the flange plate body and extending perpendicularly from an outside flange body edge of the flange plate body and transverse to the flange plate body, wherein when the flange plate tongue and the cover plate tongue are oriented in a spaced, parallel and opposed orientation wherein each of the flange plate tongue and the cover plate tongue overlap and extend towards and past each other wherein at least one of the flange plate tongue or the cover plate tongue has a threaded opening; and a height adjuster extending through one of a cover tongue opening, a flange tongue opening or both, the height adjuster is threadably disposed through the threaded opening and engages the cover plate tongue and the flange plate tongue where rotation of the height adjuster causes the cover plate tongue and the flange plate tongue to move closer or further away from each other.

2. The alignment tool of claim 1 wherein the cover plate body has an upper plate portion co-planar with the cover plate body wherein the cover plate tongue extends transversely from the outside cover body edge, the cover plate tongue being directly connected to the upper plate portion.

3. The alignment tool of claim 2 wherein the cover plate body and the upper plate portion define an L-shape.

4. The alignment tool of claim 1 wherein the flange plate body has a lower plate portion co-planar with the flange plate body wherein the flange plate tongue extends transversely from the outside flange body edge, the flange plate tongue being directly connected to the lower plate portion.

5. The alignment tool of claim 4 wherein the flange plate body and the lower plate portion define an L-shape.

6. The alignment tool of claim 1 wherein the one of the cover tongue opening, the flange tongue opening or both is threaded internally and the height adjuster is threaded externally for threadable engagement with the one of the cover tongue opening, the flange tongue opening or both.

7. The alignment tool of claim 1 further comprising a flange gusset directly connected between the lower plate portion and the flange plate tongue.

8. The alignment tool of claim 1 further comprising a cover gusset directly connected between upper plate portion and the cover plate tongue.

9. The alignment tool of claim 1 wherein the height adjuster threadably engages one of the cover tongue opening, the flange tongue opening or both.

10. The alignment tool of claim 1 wherein one of the cover tongue opening, the flange tongue opening or both is threaded internally and the height adjuster is a threaded fastener.

11. The alignment tool of claim 1 wherein one of the cover tongue opening, the flange tongue opening or both has at least one additional threaded opening.

12. A method of positioning a manway cover relative to a manway flange for aligning manway cover openings with corresponding manway flange openings, the method comprising:

providing an alignment tool comprising:

a cover plate comprising:

a cover plate body having a plurality of body openings; and a cover plate tongue fixedly attached to the cover plate body and extending perpendicularly from an outside cover body edge of the cover plate body and transverse to the cover plate body;

a flange plate comprising a flange plate body having a plurality of flange plate openings; and a flange plate tongue fixedly attached to the flange plate body and extending perpendicularly from an outside flange body edge of the flange plate body and transverse to the flange plate body, wherein, when the flange plate tongue and the cover plate tongue are oriented in a spaced, parallel and opposed orientation, each of the flange plate tongue and the cover plate tongue overlap and extend towards and past each other wherein at least one of the flange plate tongue or the cover plate tongue has a threaded opening; and a height adjuster extending through one of a cover tongue opening, a flange tongue opening or both, the height adjuster capable of engaging the cover plate tongue and the flange plate tongue, wherein the height adjuster threadably disposed through the threaded opening where rotation of the height adjuster causes the cover plate tongue and the flange plate tongue to move closer or further away from each other;

attaching the cover plate to the manway cover by aligning the plurality of body openings of the cover plate body with preselected manway cover openings;

attaching the flange plate to the manway flange by aligning the plurality of body openings of the flange plate body with preselected manway flange openings that correspond to the preselected manway flange openings wherein the cover plate tongue and the flange plate tongue are oriented in a spaced, parallel and opposed orientation wherein each of the flange plate tongue and the cover plate tongue overlap and extend towards and past each other; and operating the height adjuster to change a position of the cover plate vertically relative to the flange plate whereby the manway cover openings are positioned into alignment with corresponding manway flange openings.

13. The method of claim 12 wherein the step of operating the height adjuster includes a step selected from the group consisting of (1) threadably advancing the height adjuster through the cover plate tongue opening and engaging a top surface of the flange plate tongue, (2) threadably advancing the height adjuster through the flange plate tongue opening and engaging a bottom surface of the cover plate tongue, and (3) turning a double-ended threaded stud disposed between the cover plate tongue opening and the flange plate tongue opening thereby threadably moving the cover plate relative to the flange plate.

14. The method of claim 12, further comprising:

inserting and fastening fasteners into the aligned manway cover openings and manway flange openings thereby securing the manway cover to the manway flange;

removing the cover plate from the manway cover; and removing the flange plate from the manway flange.

* * * * *